US005653332A

United States Patent [19]

DeWitt, Jr.

[11] Patent Number: 5,653,332

[45] Date of Patent: Aug. 5, 1997

[54] KEY STORAGE DEVICE

[76] Inventor: Leslie DeWitt, Jr., 124 N. Erie, Wichita, Kans. 67214

[21] Appl. No.: 444,722

[22] Filed: May 19, 1995

[51] Int. Cl.[6] ..... A45C 11/32

[52] U.S. Cl. ..... 206/37.4; 206/37.1; 150/147; 150/151

[58] Field of Search ..... 206/37.1, 37, 37.4, 206/478, 484; 150/146, 147, 151

[56] References Cited

U.S. PATENT DOCUMENTS

| | | | |
|---|---|---|---|
| 2,703,596 | 3/1955 | Kromer | 206/37.4 |
| 3,979,051 | 9/1976 | Close | 150/147 |
| 4,286,641 | 9/1981 | Watson | 150/40 |
| 4,300,610 | 11/1981 | China | 206/37.4 |
| 4,796,750 | 1/1989 | Inghram | 206/37.4 |
| 4,942,913 | 7/1990 | Musso | 206/37.4 |
| 4,946,030 | 8/1990 | Guridi et al. | 206/37.1 |
| 4,959,983 | 10/1990 | Hsu | 70/456 R |
| 5,022,247 | 6/1991 | Beck | 70/456 R |
| 5,046,343 | 9/1991 | Miwa | 70/408 |

FOREIGN PATENT DOCUMENTS

| | | | |
|---|---|---|---|
| 1267113 | 3/1990 | Canada | 206/37.4 |

*Primary Examiner*—David T. Fidei
*Attorney, Agent, or Firm*—Kenneth H. Jack

[57] ABSTRACT

A key storage device comprising a rectangular flexible base sheet and a rectangular flexible key retaining sheet, the key retaining sheet being closely fitted to the dimensions of the base sheet, the key retaining sheet being positioned to overlie and contact the base sheet, the key retaining sheet being fixedly attached to the base sheet along its outer periphery by heat fusion welding forming a key retaining enclosure, the key retaining sheet being further fixedly attached at a centrally located point, forming a key slide stop; and the key retaining sheet having a pair of key receiving slits therethrough for the insertion of and retention of keys.

10 Claims, 4 Drawing Sheets

KEY STORAGE DEVICE

BACKGROUND OF THE INVENTION

This invention relates generally to a key storage device for holding one or two keys, the device itself being of a size and shape suitable for storage within a wallet, billfold, or pocketbook. The maintenance of a backup or a spare key for emergency purposes is desirable because keys are commonly lost or misplaced. One of the problems with maintenance of backup or spare keys is that they themselves are susceptible to being lost or misplaced. Storage of backup or spare keys in a wallet or billfold is desirable because such items are less susceptible to being lost or misplaced. However, insertion of an unprotected key into a wallet or billfold is undesirable because the rough edges of the key may cause gouging or tearing of the billfold material. Thus, it is desirable to provide a key receptacle fitted for insertion into a wallet or billfold for storage of spare or backup keys.

DESCRIPTION OF PRIOR ART

Various prior art combinations of key holders and wallets, and key holders adapted for storage within wallets are known. Examples of such prior art are:

U.S. Pat. No. 4,796,750 to Inghram, showing a flexible bifold wallet style key holder wherein keys are stored therein by sliding endwise into flexible receptacles therein.

U.S. Pat. No. 4,959,983 to Hsu showing a combination of a card shaped key holder and a key wherein the card and the head of the key comprise an interlocking hinge, allowing hinged motion of the key with respect to the card from a first position wherein the key is stored within a recess in the card, and a second position wherein the key is extended for use.

U.S. Pat. No. 4,946,030 to Guridi showing keys retained in a card shaped receptacle in apertures or recesses therein by means of a plurality of offset tabs, hinges, pivotable attachments, or offset bands, or by means of an adhesive.

U.S. Pat. No. 5,046,343 to Miwa showing a combination of a key and a card shaped key receptacle wherein the key hingedly moves with respect to the card, or wherein the key is closely fitted for storage within a slot within and through the key holder, the interior edges of the slot being grooved to receive the parallel sides of the key head.

U.S. Pat. No. 5,022,247 to Beck showing a card shaped key holder having key shaped indentations therein for receipt and storage of keys.

U.S. Pat. No. 4,286,641 to Watson showing a card shaped key holder comprising two layers of a flexible material, sealed on the outer edges and forming triangular shaped key receiving receptacles by means of a diagonal seal.

None of the aforelisted prior art patents teach or disclose the novel aspects of the present invention.

SUMMARY OF THE INVENTION

A key storage device for carrying one or two keys comprising a base sheet of flexible material. The base sheet is rectangular, its dimensions approximating those of an identification card or driver's license, which is commonly stored in a wallet. The base sheet may be translucent, transparent, or opaque. Preferably, the base sheet is opaque and of a color suitable for display of printed text or graphic images. The base sheet is preferably composed of a plastic, which may be cohesively attached to a similar plastic through heat fusion welding. The key storage device further comprises a flexible key retaining sheet having dimensions closely approximating the dimensions of the base sheet. The key retaining sheet is aligned with the base sheet so that the long and short edges of the key retaining sheet respectively overlie the long and short edges of the base sheet, and so that the planar surfaces of the base sheet and the key retaining sheet are in contact with each other. With the key retaining sheet so aligned, the outer periphery of the key retaining sheet is fixedly attached to the outer periphery of the base sheet, forming a key retaining enclosure. The key retaining sheet is preferably composed of a plastic which may be cohesively attached to the base sheet through heat fusion welding. Heat fusion welding is the preferable method of fixed attachment of the key retaining sheet to the base sheet. The key retaining sheet is further fixedly attached, preferably by heat fusion welding, to the base sheet at a point approximately centrally located on their planar surfaces, forming a key slide stop.

Keys are inserted into the key retaining enclosure by means of key receiving slits in the key retaining sheet. The slits are located upon the key retaining sheets so that keys which pass through the slits lie on either side of the key slide stop. Preferably, each slit is perpendicular to a short end of the key retaining sheet, extending inward from opposite ends to a point near the mid-line of the key retaining sheet.

By manually bending the base sheet and attached key retaining sheet, the edges of a key receiving slit may be splayed, allowing a key to be inserted between the edges of the key receiving slit, and into the key retaining enclosure. Upon release of the bend in the base sheet and key retaining sheet, the splayed edges of the key receiving slit realign with each other, forming a closure for retaining the key within the key retaining enclosure. When two keys are contained with the enclosure, the key slide stop prevents the keys from sliding into one another and overlying one another. The key slide stop preferably is small in size with respect to the dimensions of the key retaining enclosure, allowing the key slide stop to act as a pivot point and allowing the heads of keys contained within the enclosure to be slidably rotated about the key slide stop, causing the key retaining enclosure to be capable of containing keys with oversized heads. The small size of the key slide stop also reduces interference of the key slide stop with graphics and text printed upon the base sheet. Preferrably, the key slide stop is a short line parallel to the long ends of the enclosure, so as not to interfere with lines of text printed on the base sheet.

The key retaining sheet, if transparent, serves as a window for viewing text and images printed on the base sheet, or for viewing keys within the enclosure.

In an alternate configuration, the key storage device further comprises a flexible card retaining sheet of approximately the same dimensions as the base sheet, the long and short ends of the card retaining sheet respectively overlying the long and short ends of the base sheet, and the planar surface of the card retaining sheet being in contact with the surface of the base sheet opposite the key retaining sheet. The card retaining sheet is preferably composed of a plastic capable of being cohesively attached to the base sheet through heat fusion welding. Also, preferably, the card retaining sheet is transparent. The long ends and a short end of the card retaining sheet are fixedly attached to the corresponding ends of the base sheet, preferably by heat fusion welding, forming a card retaining pocket.

The card retaining sheet has an aperture positioned to underlie the key slide stop on the reverse side of the base sheet. The aperture prevents the card retaining sheet from adhering to the base sheet when heat is applied to the key retaining sheet to form the key slide stop. Similarly, the long dimension of the card retaining sheet is shorter than the long dimension of the base sheet by the width of a heat fusion weld, so that the opening of the card retaining pocket is not sealed when heat is applied to that edge of the enclosure.

Business and promotional cards may be inserted into the card retaining pocket. When a card is inserted into the card retaining pocket, the card retaining sheet serves as a window for viewing the card. When no card is contained within the card retaining pocket, the transparent card retaining sheet serves as a window for viewing text or images which may be printed upon the base sheet.

It is an object of this invention to provide an improved key holder for storage of keys in wallets and billfolds.

It is another object of this invention to provide a key storage device for one or two keys, which is additionally capable of storing and displaying a business or promotional card.

It is a further object of this invention to provide a key storage device which is economically constructed, and which securely holds spare keys within a wallet or billfold, preventing loss of the spare keys.

In accordance with these and other objects which will be apparent hereinafter, the instant invention will now be described with particular reference to the accompanying drawings.

DESCRIPTION OF THE PREFERRED EMBODIMENT

Figure 1:
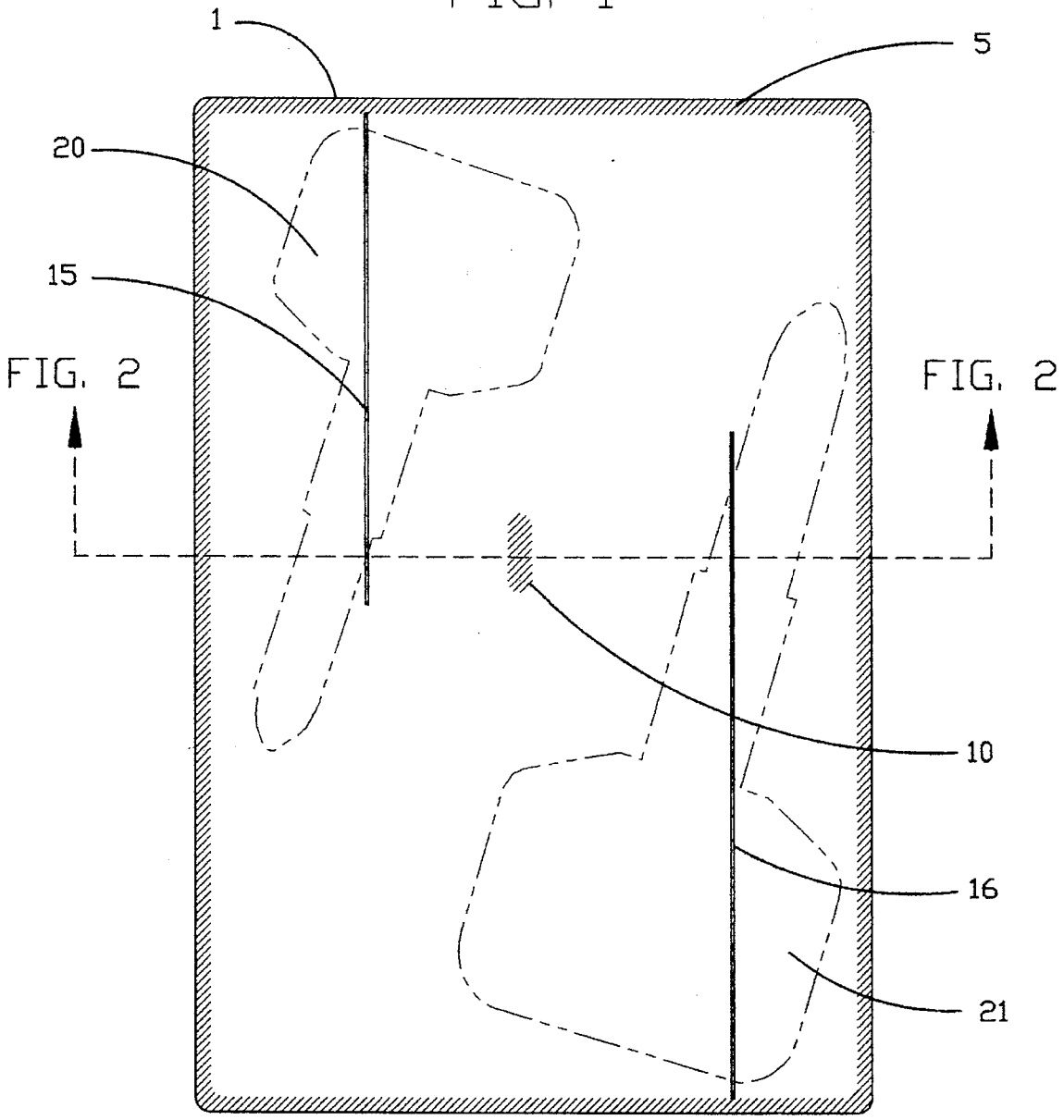
FIG. 1 is a frontal view of the key storage device.
Figure 2:
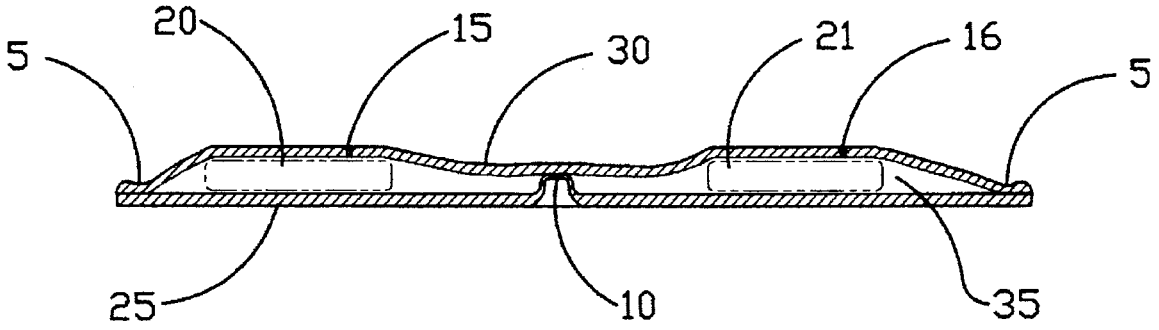
FIG. 2 is a cross-sectional view of the key storage device.

Referring simultaneously to FIGS. 1 and 2, a key storage device 1 is shown. The key storage device 1 is composed of a flexible base sheet 25 and a flexible key retaining sheet 30. Both the base sheet 25 and the key retaining sheet 30 are composed of plastic materials capable of fixed attachment to each other through heat fusion welding. The base sheet 25 is opaque and is of a color suitable for printing and display of text and graphic images. The key retaining sheet 30 is transparent. The key retaining sheet is fixedly attached to the base sheet by means of a heat fusion weld 5 which surrounds the perimeter of the key storage device 1, forming a flexibly expandable key retaining enclosure 35. The key retaining sheet 30 is further fixedly attached to the base sheet 25 by heat fusion welding at a point approximately centrally located on the planar surface of the key storage device 1, forming a key slide stop 10. The key slide stop 10 serves the purpose of preventing keys 20 and 21 contained within the key retaining enclosure 35 from sliding into and overlying each other.

Keys 20 and 21 are inserted through the key retaining sheet 30 and into the key retaining enclosure 35 by means of key receiving slits 15 and 16. The key receiving slits 15 and 16 lie on either side of the key slide stop 10, extending inwardly from opposing short ends of the key storage device 1; the key receiving slits 15 and 16 being substantially perpendicular to the short ends and extending to points near the mid-line of the key storage device 1. Passage of keys 20 and 21 through the key receiving slits 15 and 16 is accomplished by flexibly bending the key storage device 1, causing the edges of the key receiving slits 15 and 16 to splay away from each other. The splayed edges of the key receiving slits 15 and 16 form apertures into which keys 20 and 21 may be inserted. After insertion of keys 20 and 21, the key storage device 1 may be flexibly bent to return to an approximately flat surface, causing the splayed edges of the key receiving slits 15 and 16 to realign with each other, forming a closure for retention of keys 20 and 21 inside of the key retaining enclosure 35. Removal of keys 20 and 21 from the key retaining enclosure 35 is accomplished through reversal of this process.

When keys 20 and 21 are contained within the key retaining enclosure 35, the transparent key retaining sheet 30 serves as a window for viewing the keys 20 and 21. When keys are not contained with the key retaining enclosure 35, the transparent key retaining sheet 30 serves as a window for viewing text and images which may be printed on the base sheet 25.

The overall size and dimensions of the key storage device 1 approximate the size and dimensions of an identification card or credit card which is commonly stored in a wallet or billfold.

Figure 3:
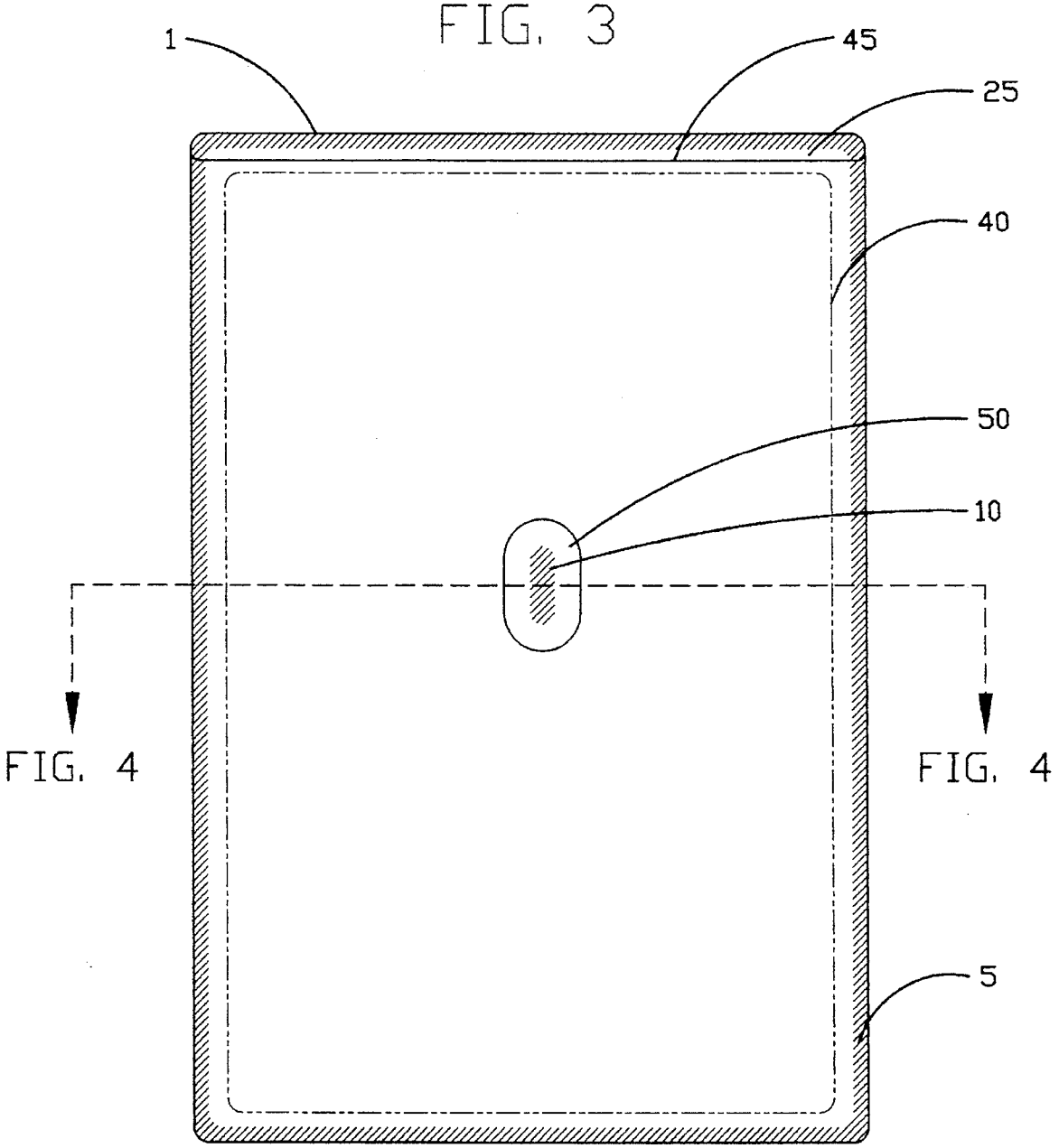
FIG. 3 is a frontal view of the reverse side of the alternate configuration of the key storage device.
Figure 4:
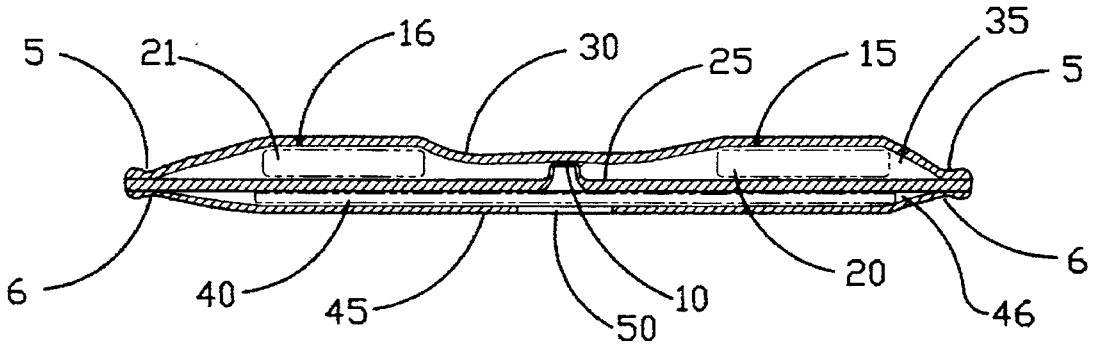
FIG. 4 is a cross-sectional view of the alternate configuration of the key storage device.

Referring simultaneously to FIGS. 3 and 4, an alternate configuration, the key storage device 1 further comprises a flexible transparent card retaining sheet 45 preferably composed of a plastic material capable of attachment to the base sheet 25 by heat fusion welding. The card retaining sheet 45 is fixedly attached to the side of the base sheet 25, which is opposite the key retaining sheet 30 by means of a heat fusion weld 6. The heat fusion weld 6 extends the length of the two longs ends of the key storage device 1, and along a short end of the key storage device 1, leaving a short end of the card retaining sheet unattached to the corresponding short end of the base sheet 25, forming an open ended card retaining pocket 46.

Heat fusion welding of the key retaining sheet 30 to the base sheet 25 potentially causes adhesion of the card retaining sheet 45 to the base sheet 25 at points underlying the key slide stop 10 and along the opening of the card retaining pocket 46, thus preventing a card 40 from slidably moving into the card retaining pocket 46. To prevent such unwanted attachment of the card retaining sheet 45 to the base sheet 25, the card retaining sheet 45 has an aperture 50 which underlies the key slide stop 10. Also, to prevent such unwanted attachment, the long dimension of the card retaining sheet 45 is shortened by the width of a heat fusion weld so that the end of the card retaining sheet 45 which serves as the opening of the card retaining pocket 46 does not underlie the heat fusion weld 5 by which the key retaining sheet 30 is attached to the base sheet 25.

When a card 40 is inserted into the card retaining pocket 46, the transparent card retaining sheet 45 serves as a window for viewing the card 40. When no card is inserted into the card retaining pocket 46, the card retaining sheet 45 serves as a window for viewing printed text and images which may be printed on the base sheet 25.

The invention described above is considered only as a preferred embodiment. Other or different embodiments within the scope of the invention, and obvious modifications may occur to persons skilled in the art.

I claim:

1. A flexible rectangular base sheet, and a flexible rectangular key retaining sheet; the key retaining sheet being closely fitted to the dimensions of the base sheet; the key retaining sheet being positioned to overlie the base sheet so that their planar surfaces are in contact with each other and so that the long and short ends of the key retaining sheet respectively overlie the long and short ends of the base sheet; the key retaining sheet being fixedly attached to the base sheet along its outer periphery forming a key retaining enclosure capable of containing keys; the device further comprising a key slide stop, the key slide stop being a point at which the key retaining sheet is fixedly attached to the base sheet, preventing keys contained within the key retaining enclosure from sliding into and overlying each other, the key slide stop being positioned upon the base sheet and key retaining sheet at a point near their geometric centers, and the key slide stop having dimensions small enough with respect to the dimensions of the key retaining enclosure to allow the heads of keys contained within the key retaining enclosure to be slidably rotated about the key slide stop causing the key retaining enclosure to be capable of containing large headed keys; and the key retaining sheet having a pair of key receiving slits therethrough for the insertion of keys into the key retaining enclosure, the slits each being substantially perpendicular to and extending from the opposing short ends of the key retaining sheet, and the slits being positioned on either side of the key slide stop.

2. The device of claim 1, wherein the base sheet and the key retaining sheet are composed of plastic materials capable of fixed attachment to each other through heat fusion welding.

3. The device of claim 2, wherein the means of fixed attachment of the key retaining sheet to the base sheet is heat fusion welding.

4. The device of claim 3, wherein the base sheet is opaque, and wherein the key retaining sheet is transparent.

5. The device of claim 1 further comprising a flexible card retaining sheet; the card retaining sheet being closely fitted to the dimensions of the base sheet; the card retaining sheet being positioned to underlie the base sheet so that their planar surfaces are in contact with each other, and so that the long and short ends of the card retaining sheet respectively underlie the long and short ends of the base sheet; and the card retaining sheet being fixedly attached to the base sheet along three of its four sides, forming a card retaining pocket capable of containing a card.

6. The device of claim 5, wherein the base sheet, the key retaining sheet, and the card retaining sheet are composed of plastic materials capable of fixed attachment to each other by means of heat fusion welding.

7. The device of claim 6, wherein the fixed attachments of the key retaining sheet to the base sheet, and of the card retaining sheet to the base sheet are heat fusion welds.

8. The device of claim 7, wherein the base sheet is opaque, and wherein the key retaining sheet and the card retaining sheet are transparent.

9. A flexible rectangular base sheet, and a flexible rectangular key retaining sheet; the key retaining sheet being closely fitted to the dimensions of the base sheet; the key retaining sheet being positioned to overlie the base sheet so that their planar surfaces are in contact with each other and so that the long and short ends of the key retaining sheet respectively overlie the long and short ends of the base sheet; the key retaining sheet being fixedly attached to the base sheet along its outer periphery formic a key retaining enclosure capable of containing keys; the key retaining sheet being further fixedly attached to the base sheet at a point near its geometric center, formic a key slide stop to prevent keys within the key retaining enclosure from sliding into and overlying each other; and the key retaining sheet having a pair of key receiving slits therethrough for the insertion of keys into the key retaining enclosure, the slits each being substantially perpendicular to and extending from the opposing short ends of the key retaining sheet, and the slits being positioned on either side of the key slide stop, the device further comprising a flexible card retaining sheet; the card retaining sheet being closely fitted to the dimensions of the base sheet; the card retaining sheet being positioned to underlie the base sheet so that their planar surfaces are in contact with each other, and so that the long and short ends of the card retaining sheet respectively underlie the long and short ends of the base sheet; and the card retaining sheet being fixedly attached to the base sheet along three of its four sides, forming a card retaining pocket capable of containing a card; wherein the base sheet, the key retaining sheet, and the card retaining sheet are composed of plastic materials capable of fixed attachment to each other through heat fusion welding, wherein the fixed attachments of the key retaining sheet to the base sheet, and of the card retaining sheet to the base sheet, are heat fusion welds, wherein the base sheet is opaque, wherein the key retaining sheet and the card retaining sheet are transparent, wherein the card retaining sheet has an aperture therethrough, the aperture being positioned to underlie the key slide stop to prevent the card retaining sheet from becoming attached to the base sheet at points underlying the key slide stop upon the application of heat to the key slide stop.

10. A flexible rectangular base sheet, and a flexible rectangular key retaining sheet; the key retaining sheet being closely fitted to the dimensions of the base sheet; the key retaining sheet being positioned to overlie the base sheet so that their planar surfaces are in contact with each other and so that the long and short ends of the key retaining sheet respectively overlie the long and short ends of the base sheet; the key retaining sheet being fixedly attached to the base sheet along its outer periphery forming a key retaining enclosure capable of containing keys; the device further comprising a key slide stop, the key slide stop being a point at which the key retaining sheet is fixedly attached to the base sheet, preventing keys contained within the key retaining enclosure from sliding into and overlying each other, the key slide stop being positioned upon the base sheet and key retaining sheet at a point near their geometric centers, and the key slide step having dimensions small enough with respect to the dimensions of the key retaining enclosure to allow the heads of keys contained within the key retaining enclosure to be slidably rotated about the key slide stop causing the key retaining enclosure to be capable of containing large headed keys; and the key retaining sheet having a pair of key receiving slits therethrough for the insertion of keys into the key retaining enclosure, the slits each being substantially perpendicular to and extending from the opposing short ends of the key retaining sheet, and the slits being positioned on either side of the key slide stop, the device further comprising a flexible card retaining sheet; the card retaining sheet being closely fitted to the dimensions of the base sheet; the card retaining sheet being positioned to underlie the base sheet so that their planar surfaces are in contact with each other, and so that the long and short ends of the card retaining sheet respectively underlie the long and short ends of the base sheet; and the card retaining sheet being fixedly attached to the base sheet along three of its four sides, forming a card retaining pocket capable of containing a card; wherein the base sheet, the key retaining sheet, and the card retaining sheet are composed of plastic materials capable of fixed attachment to each other through heat fusion welding, wherein the fixed attachments of the key retaining sheet to the base sheet, and of the card retaining sheet to the base sheet, are heat fusion welds, wherein the card retaining sheet has an aperture therethrough, the aperture being positioned to underlie the key slide stop to prevent the card retaining sheet from becoming attached to the base sheet at points underlying the key slide stop upon the application of heat to the key slide stop.

* * * * *